US007049923B2

(12) United States Patent
Skinner et al.

(10) Patent No.: US 7,049,923 B2
(45) Date of Patent: May 23, 2006

(54) IGNITION COIL ASSEMBLY UTILIZING A SINGLE INTERNAL FLOATING SHIELD BUFFERED AT ONE END

(75) Inventors: Albert Anthony Skinner, Anderson, IN (US); James Patrick Henry, Noblesville, IN (US); Jeff A. King, Markleville, IN (US)

(73) Assignee: Delphi Technologies, Inc., Troy, MI (US)

( * ) Notice: Subject to any disclaimer, the term of this patent is extended or adjusted under 35 U.S.C. 154(b) by 105 days.

(21) Appl. No.: 10/860,800

(22) Filed: Jun. 3, 2004

(65) Prior Publication Data

US 2005/0270134 A1 Dec. 8, 2005

(51) Int. Cl.
*H01F 27/02* (2006.01)

(52) U.S. Cl. ..... 336/90; 336/92; 336/96

(58) Field of Classification Search ..... 336/92, 336/90, 96

See application file for complete search history.

(56) References Cited

U.S. PATENT DOCUMENTS

| | | | | |
|---|---|---|---|---|
| 5,015,982 | A | 5/1991 | Skinner | 336/69 |
| 5,632,259 | A * | 5/1997 | Konda et al. | 123/634 |
| 5,929,736 | A | 7/1999 | Sakamaki | 336/96 |
| 6,255,930 | B1 * | 7/2001 | Kanazawa et al. | 336/96 |
| 6,457,229 | B1 * | 10/2002 | Kanazawa et al. | 29/602.1 |
| 6,463,918 | B1 | 10/2002 | Moga | 123/633 |
| 6,556,118 | B1 | 4/2003 | Skinner | 336/182 |
| 6,700,470 | B1 * | 3/2004 | Butler et al. | 336/96 |
| 6,781,500 | B1 * | 8/2004 | Kawai et al. | 336/198 |
| 6,810,868 | B1 * | 11/2004 | Tsunenaga et al. | 123/634 |

* cited by examiner

*Primary Examiner*—Anh Mai
(74) *Attorney, Agent, or Firm*—Jimmy L. Funke

(57) ABSTRACT

An ignition apparatus includes a core formed of magnetically-permeable material extending along a main axis, a primary winding disposed about the core, a secondary winding disposed on a secondary winding spool wherein at least one of the secondary winding leads is connected to a high-voltage connector terminal configured for connection to a spark plug, a case formed of electrical insulating material, and a magnetically-permeable shield disposed inwardly of the case and allowed to electrically float with respect to ground and a power source.

11 Claims, 3 Drawing Sheets

IGNITION COIL ASSEMBLY UTILIZING A SINGLE INTERNAL FLOATING SHIELD BUFFERED AT ONE END

FIELD OF THE INVENTION

The present invention relates generally to ignition coils for developing a spark firing voltage that is applied to one or more remotely mounted spark plugs of an internal combustion engine.

DESCRIPTION OF THE RELATED ART

It is known to provide an ignition coil assembly utilizing a progressive wound secondary winding disposed remotely from the spark plugs as seen by reference to U.S. Pat. No. 6,556,118 entitled "SEPARATE MOUNT IGNITION COIL UTILIZING A PROGRESSIVE WOUND SECONDARY WINDING" issued to Skinner ("Skinner"). Skinner disclose an ignition coil assembly wherein a shield is located outwardly of a case and (which is electrically grounded) whereby the case defines a significant dielectric member, as in a traditional "pencil" coil. A "pencil" ignition coil, as known, exhibits a relatively slender shape configured to be mounted directly above and to a spark plug. In Skinner, the shield must be grounded and accordingly the case material selection is limited to certain materials (e.g., polyethylene terephthalate (PET) thermoplastic polyester, commercially available under the trade name RYNITE®) that can withstand the partial discharge that inevitably occurs between the case and the shield. These materials are more expensive than alternative materials that are available to perform the mechanical requirements of the case.

It is also known to provide an ignition apparatus having an electrically floating shield as seen by reference to U.S. Pat. No. 6,463,918 entitled "IGNITION APPARATUS HAVING AN ELECTRICALLY FLOATING SHIELD" issued to Moga et al.

There is therefore a need to provide an improved ignition coil that minimizes or eliminates one or more of the shortcomings as set forth above.

SUMMARY OF THE INVENTION

A separate-mount style ignition apparatus in accordance with the present invention includes, among other things, a shield that is allowed to electrically float, which reduces electrical stress, thereby allowing use of reduced cost materials for making the case.

These and other advantages are realized by an ignition apparatus in accordance with the present invention, which includes a core formed of magnetically-permeable material extending along a main axis, a primary winding disposed about the core, a secondary winding disposed on a secondary spool wherein at least one of first and second ends of the secondary winding is electrically connected to a high-voltage connector terminal configured for connection to a spark plug, a case formed of electrical insulating material, and a magnetically-permeable electrically-conductive shield disposed inwardly of the case, the shield electrically floating relative to a ground node and/or a power source.

BRIEF DESCRIPTION OF THE DRAWINGS

The present invention will now be described by way of example, with reference to the accompanying drawings in which.

DETAILED DESCRIPTION OF THE PREFERRED EMBODIMENT

Figure 1:
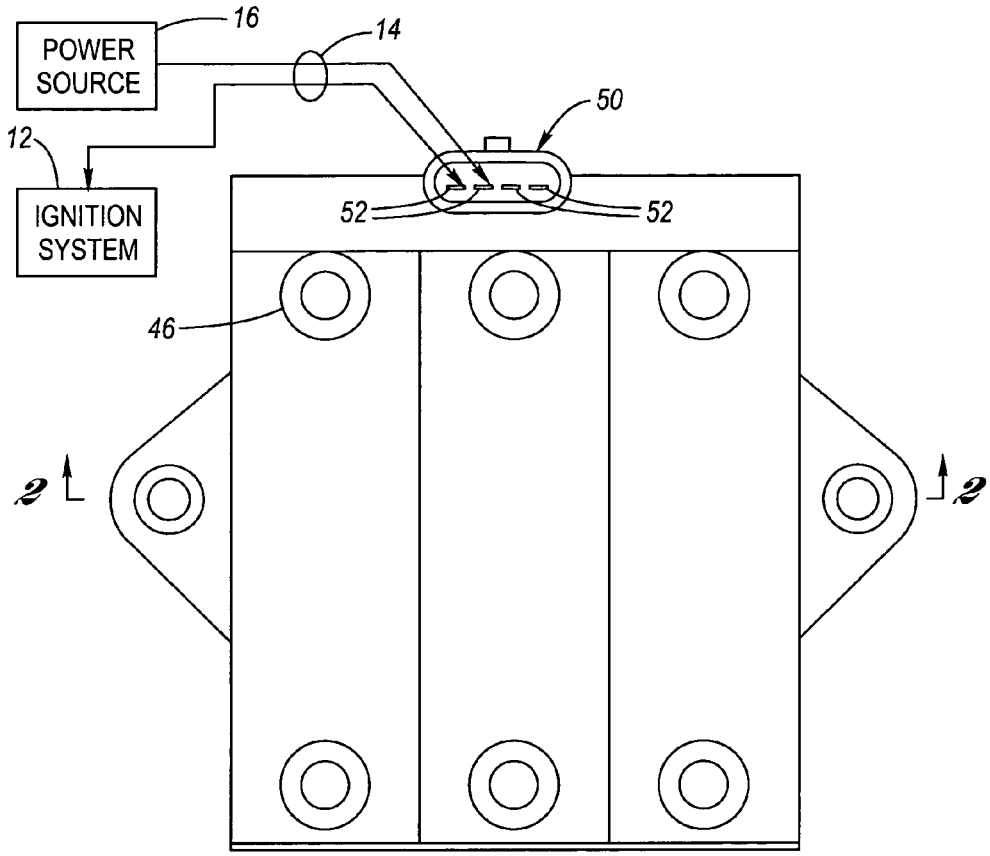
FIG. 1 is a simplified, plan view of an ignition apparatus in accordance with the present invention.

Referring now to the drawings wherein like reference numerals are used to identify identical components in the various views, FIG. 1 is a top plan view of an ignition apparatus 10 in accordance with the present invention. As is generally known, ignition apparatus 10 may be coupled to, for example, an ignition system 12, which may be configured to contain circuitry for controlling the charging and discharging of apparatus 10.

The apparatus 10 may be coupled by way of a cable 14 or the like to (i) ignition control system 12 and (ii) a power source 16 (e.g., a battery in an automotive vehicle embodiment).

Figure 2:
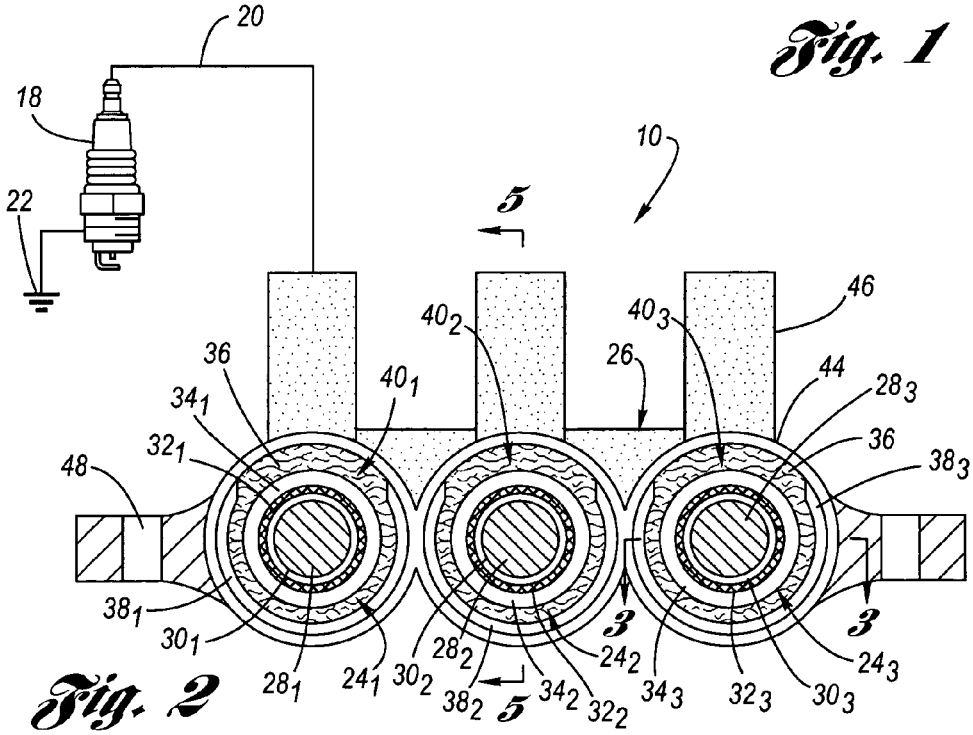
FIG. 2 is a simplified, cross-section view of the ignition apparatus shown in FIG. 1 taken substantially along lines 2—2.

With reference to FIG. 2, the relatively high-voltage produced by ignition apparatus 10 is provided to a spark plug 18 remotely mounted from ignition apparatus 10 by way of a conventional high-voltage (HV) ignition cable 20. Spark plug 18 may be retained by a threaded engagement with a spark plug opening in a combustion chamber of the engine (as conventional) with the shell of the plug 18 being coupled to an electrical ground node 22. The resulting spark event may be employed to initiate combustion in a combustion chamber of an internal combustion engine. Such an engine (not shown) may be used to power, for example, an automotive vehicle.

The ignition apparatus 10 shown in FIGS. 1 and 2 is adapted for use with a six-cylinder engine and is further configured for operation in a so-called distributorless ignition system (DIS) where a given secondary winding is connected to two spark plugs (i.e., a so-called waste spark system).

Ignition apparatus 10 is further adapted for installation in an engine compartment of an automotive vehicle, preferably, to an engine (or portion thereof) directly or to a side wall or the like of the engine compartment. Ignition apparatus 10 may be remotely mounted from the spark plug 18, thereby requiring an electrical connection, such as an ignition cable 20, to obtain the desired operation.

The configuration for an ignition apparatus to be described in detail hereinafter reduces cost by utilizing a shield that is electrical floating with respect to ground node 22 and/or power source 16 and is disposed inwardly of the case in lieu of a grounded shield outwardly of the case.

A detailed description of a preferred embodiment will now be set forth. With a continued reference to FIG. 2, in accordance with the present invention, ignition apparatus 10 includes one or more coil assemblies, illustrated as three coil assemblies designated $\mathbf{24}_1$, $\mathbf{24}_2$ and $\mathbf{24}_3$ and a case assembly 26.

Coil assemblies $\mathbf{24}_1$, $\mathbf{24}_2$ and $\mathbf{24}_3$ are each configured generally for transforming a relatively low voltage (e.g., 12 volts obtained from a conventional vehicle battery) to a relatively high voltage sufficient to produce a spark across the gap of the spark plug 18. Inasmuch as the illustrated embodiment is configured for use in a waste spark system, each coil assembly 24 fires two spark plugs disposed in respective cylinders of the engine. For example, the coil assembly designated 241 may be arranged to provide a spark firing voltage to spark plugs disposed in engine cylinder nos. 1 and 4. This result is achieved by connecting first and second ends of the secondary winding to respective high voltage connector terminals in respective towers for each cylinder, which are then connected to the spark plugs for cylinder nos. 1 and 4 via multiple cables 20. Ignition apparatus 10 further includes coil assembly $\mathbf{24}_2$ for cylinder nos. 2 and 5 (example only), and coil assembly $\mathbf{24}_3$ for cylinder nos. 3 and 6 (example only).

FIG. 2 shows a partial detail of coil assembly 24. Each coil assembly $\mathbf{24}_i$ (where i=1, 2 or 3) includes a primary winding assembly comprising a central core 28, a primary winding 30, a secondary winding spool 32, a secondary winding 34 that is wound on secondary winding spool 32, and encapsulant 36.

Figure 3:
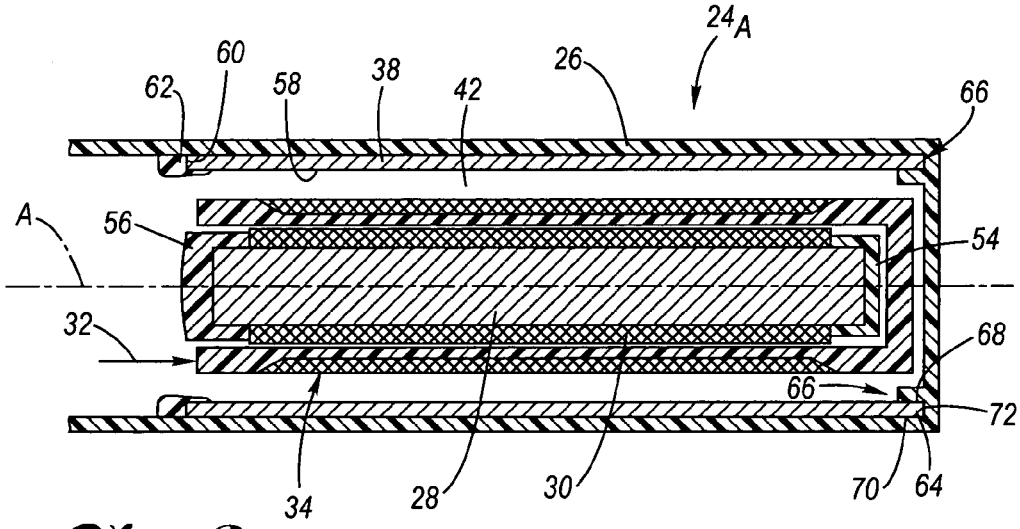
FIG. 3 is a simplified, cross-section view of the ignition apparatus shown in FIG. 2 taken substantially along lines 3—3.

Core 28 may be elongated, having a main, longitudinal axis associated therewith, designated axis "A" (best shown in the FIG. 3). Core 28 includes an upper, first end and a lower, second end. Core 28 comprises magnetically-permeable material, such as a plurality of silicon steel laminations, or, alternatively, plastic coated iron particles formed in a compression molding operation, as known in the art, for example, as disclosed in U.S. Pat. No. 5,015,982 entitled "IGNITION COIL," hereby incorporated by reference in its entirety. As illustrated, core 28 may assume a generally cylindrical shape (which has a generally circular shape in radial cross-section).

Primary winding 30 may be wound directly onto core 28; however, in a constructed embodiment, primary winding 30 is wound on a tape layer or shrink tube layer of an electrical insulating material (e.g., a polyester film, such as MYLAR® tape or shrink tube or a polyimide film, such as KAPTON® tape) disposed over the core 28. Primary winding 30 includes first and second ends and is configured to carry a primary current Ip for charging the respective coil assembly (i.e., one of $\mathbf{24}_1$, $\mathbf{24}_2$ and $\mathbf{24}_3$) under the control of ignition system 12. Winding 30 may be implemented using known approaches and conventional materials.

Secondary winding spool 32 is configured to receive and retain secondary winding 34. Spool 32 is disposed adjacent to and radially outwardly of the central components comprising core 28 and primary winding 30. Preferably, spool 32 is in coaxial relationship with core 28 and primary winding 30.

Spool 32 is formed generally of electrical insulating material having properties suitable for use in a relatively high temperature environment. For example, spool 32 may comprise plastic material such as polybutylene terephthalate (PBT) thermoplastic polyester.

The winding approach for secondary 34 may be a progressive wound secondary winding or a segment wound secondary winding (not shown), both of which may be of conventional designs known in the art.

A dielectric material, such as epoxy potting material 36, is included for encapsulating each coil assembly 24.

In accordance with the present invention, a shield 38 is placed radially inwardly of case 26 and is allowed to float electrically with respect to ground node 22 and/or power source 16. Each shield 381, 382 and 383 in the illustrated embodiment is generally cylindrical in shape extending along main axis "A." Of course, the shape of the shield 38 may be altered to accommodate a differing shaped case. There are three separate shields $\mathbf{38}_1$, $\mathbf{38}_2$ and $\mathbf{38}_3$ shown in FIG. 2. In the illustrated embodiment, the epoxy potting material 36 defines a dielectric member (i.e., electrically insulating layer) between the outside diameter of the secondary winding 34 and shield 38. The epoxy thickness therefore needs to be increased relative to that found in conventional designs to increase the level of dielectric isolation. The radial spacing therefore between the outside diameter of the secondary winding 34 and the shield 38 thus needs to be increased. The increased spacing aids the epoxy flow into and around each coil assembly 24. As shown in FIG. 2, each shield in the illustrated embodiment includes a respective opening $\mathbf{40}_1$, $\mathbf{40}_2$ and $\mathbf{40}_3$ extending circumferentially and axially relative to the main axis "A" (best shown in FIG. 3). Accordingly, each shield may thus assume a C-shape or a U-shape when taken in radial cross-section. The opening 40 for each shield defines a respective flow path for epoxy potting material 36, providing an increased clearance for the potting material 36.

The opening 40 is preferably oriented so as to correspond to the placement of the high voltage towers to thereby allow routing of the high voltage from the end(s) of the secondary winding to the respective HV connector terminal. Shields $\mathbf{38}_i$ may be formed of electrically conductive, magnetically-permeable material, such as 1008 steel.

Referring to FIGS. 1 and 2, case 22 forms an enclosure for receiving various sub-assemblies. Case 22 includes an interior 42 defined by a base wall and a plurality of side walls, an exterior surface 44, a plurality of towers 46 one for each cylinder extending outwardly from exterior surface 44 and a plurality of mounting holes 48.

In accordance with the present invention, the arrangement for shield 38 described above allows the use of less costly materials for case 22, since the resistance to erosion due to sparking does not have to be as great as with conventional designs. The material for case 22 need only satisfy the mechanical requirements of the case. These materials may include polybutylene terephthalate (PBT) such as commercially provided under the traemark VALOX® by G.E. Plastics, or lower dielectric grades of polyethylene terephthalate (PET).

Connector body 50 is configured to provide an interface between the coil assemblies 18*i* and ignition system 12 and comprises, generally, electrical insulating material having properties suitable for use in a relatively high temperature environment. Apparatus 10 may be configured to include power switching circuitry operative to carry primary energization current in response to electronic spark timing command signals originating from ignition system 12. These command signals may be provided to apparatus 10 via connector 50. Connector body 50 may comprise plastic material such as polyethylene terephthalate (PET) thermoplastic polyester, commercially available under the trade name RYNITE® specification RE5220 BK533, from E. I. du Pont de Nemours and Company, Wilmington, Del., USA. It should be understood that there are a variety of alternative materials, which may be used for connector body 50 known to those of ordinary skill in the art, the foregoing being exemplary only and not limiting in nature.

Terminals 52 provide a male-type connector half, which, in cooperation with an industry standard, corresponding female connector, forms an electrical connection that carries signals (ignition control or electronic spark timing (EST) signals) from ignition system 12 and power source 16. As is generally known, assertion of one of the electronic spark timing signals commences a "dwell" interval, which ends when such signal is discontinued. Primary current Ip builds up during the dwell interval. Interrupting the primary current causes a high voltage to be produced by the coil that results in the spark plug in the corresponding cylinder firing.

Referring now to FIG. 3, a first embodiment of a coil assembly is shown, designated $\mathbf{24}_A$. FIG. 3 shows a core buffer 54, a cap 56, a release coating 58 on shield 38, a first end 60 of shield 38, an annular shield buffer 62 located at the first end 60, a second end 64 of shield 38, and an annular channel 66 defined by an inner diameter annular wall 68, an outer diameter annular wall 70 and an annular base wall 72.

The core buffer cup 54 is disposed on one end of the core 28 and the cap 56 is disposed on the other end of core 28. Both configured to hold the ends of the primary winding 30 in place. They may each comprise electrical insulating material.

The shield 38 is provided with release coating 58 so that the epoxy potting material 36 or other encapsulant will not adhere to the radially inwardly facing surface of shield 38.

Release coating 58 may include a based on silicone-based glaze known sometimes as a "pan glaze." Another alternative is a product called SILBIONE 76405 (sold by Rhone Poulenc). Polytetrafluoroethylene (e.g., Teflon® by DuPont) coatings have also been used for release coating 58.

Annular shield buffer 62 is configured to compensate for the effects of thermal expansion so as to minimize or eliminate adverse effects. Annular shield buffer 62 is located at first end 60 of shield 38 and may comprise electrically insulating material having a first thermal expansion characteristic. The difference in thermal expansion between shield 38 and the epoxy potting material 36 is accounted for by the annular shield buffer element 62 so that the total expansion of the shield 38 and the buffer 62 is substantially equal to the expansion of the epoxy potting material 36. Reducing or eliminating differences in the level of thermal expansion reduces or eliminates the occurrence of mechanical stress, which can cause breakdown of the material itself.

As shown in FIG. 3, the second end 64 of shield 38 and channel 66 are arranged to provide a press-fit coupling therebetween. Channel 66 is configured to minimize the collection of epoxy potting material 36 around the end of shield 38. Through the foregoing, the effects of differences in the rate of thermal expansion described above, between the epoxy potting material and the shield 38 can be minimized or eliminated. The same advantages apply.

Allowing shield 38 to electrically float reduces the electrical stress (i.e., the stress due to electric fields) in the epoxy potting material, thereby also reducing the occurrence of break downs in the material itself (along with the accompanying arcing, shorting, and the like).

Figure 4A:
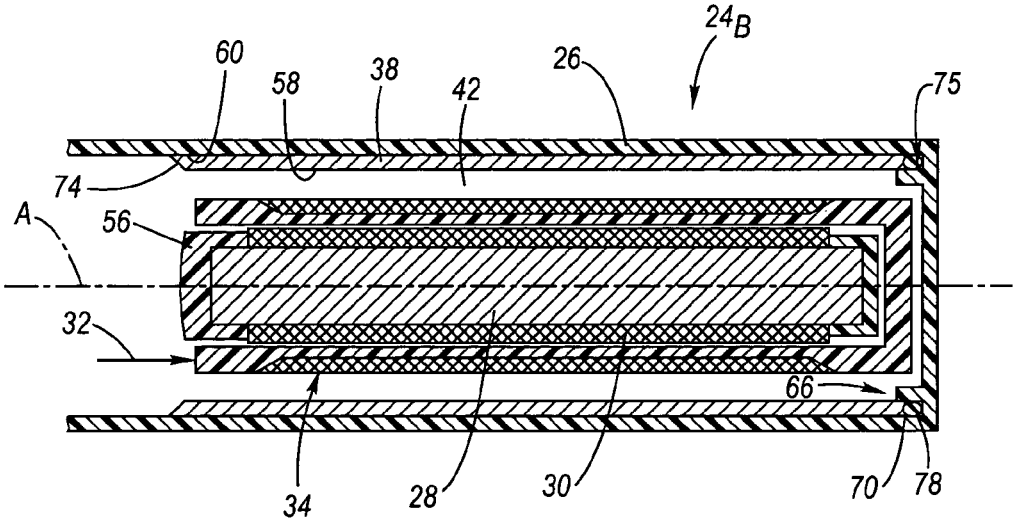
FIG. 4A is an alternate embodiment of FIG. 3 having a circular cross-section O-ring seal.
Figure 4B:
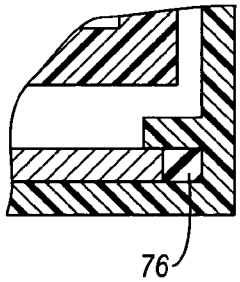
FIG. 4B is an alternate embodiment of FIG. 3 having a rectangular cross-section O-ring seal.

FIGS. 4A and 4B show alternate embodiments of the coil assembly, designated 24B. In the embodiments of FIGS. 4A and 4B, alternative approaches are illustrated for placing the shield 38 in the case 26. In this regard, the first end 60 of shield 38 includes a coined edge 74, rather than a standard flat edge, in combination with the annular shield buffer element 62, as shown in FIG. 3. Furthermore, at the second end 64 of shield 38, in the alternative embodiment, a seal element 75 between the shield 38 and channel 66 is provided in lieu of a press-fit, fully-seated arrangement. As shown in greater detail, seal 75 may comprise an O-ring seal 76 having a circular cross-section (FIG. 4A), or an O-ring seal 78 having a substantially rectangular cross-section (FIG. 4B). It should be understood that the O-ring seal is intended to act as a buffer since it is in line with the shield and thus allows the shield to move so as to absorb the difference due to thermal expansion just as the buffer cup on the other end of the assembly in embodiment 24A.

Figure 5:
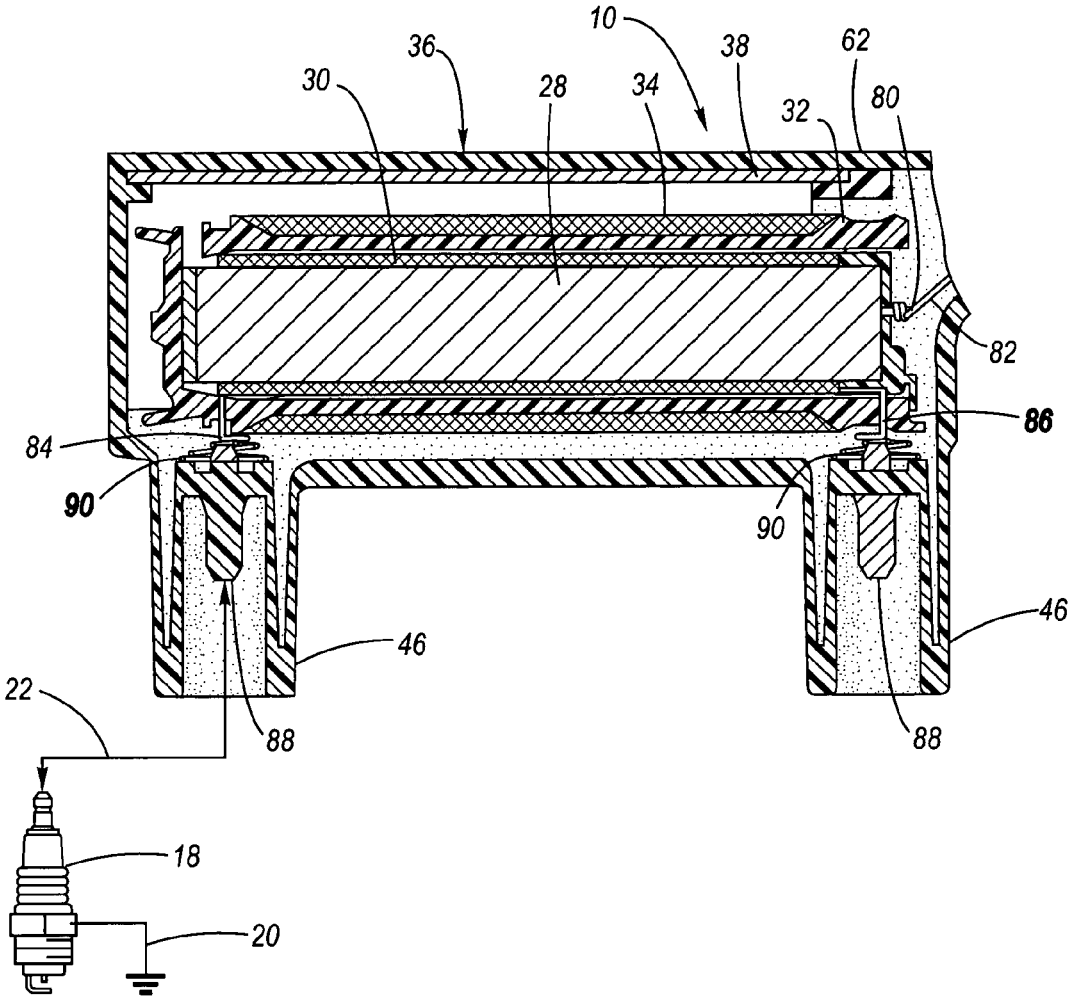
FIG. 5 is a simplified, cross-section view of the ignition apparatus shown in FIG. 2 taken substantially along lines 5—5.

FIG. 5 is a cross-section view of ignition apparatus 10 taken substantially along lines 5—5 in FIG. 2. FIG. 5 shows a primary winding end 80 coupled via a connecting wire 82 to energization circuitry (not show in FIG. 5). The energization circuitry selectively couples the primary winding between the power source 16 and ground 22 to allow build up of the primary current, all as known.

Referring to FIG. 5, secondary winding spool 32 also includes a first high-voltage terminal 84, and a second high-voltage terminal 86, preferably insert molded in the spool body. Terminals 84 and 86 comprise electrically conductive material, such as metal. These HV terminals 84, 86 are configured to be connected to corresponding HV towers in a manner described below.

Secondary winding 34, as described above, is wound on spool 32, and includes first and second ends or leads. Each end is connected to a respective one of high-voltage terminals 84, and 86. As known, an interruption of a primary current Ip through primary winding 30, as controlled by ignition system 12, is operative to produce a high-voltage at these ends of secondary winding 34. Secondary winding 34 may be wound in accordance with a progressive winding approach, which is known generally, for example, as seen by reference to U.S. Pat. No. 5,929,736 entitled "ENGINE IGNITING COIL DEVICE AND METHOD OF WINDING AN IGNITION COIL" issued to Sakamaki et al., hereby incorporated by reference for this purpose. In particular, the progressive wound secondary winding 34 may be formed having a predetermined number of layers wherein each layer of secondary winding 34 is disposed at preselected angles taken in an axial direction, on the smooth outer surface of spool body.

With continued reference to FIG. 5, case assembly 22 may further include a bushing 86, a plurality of high-voltage connector terminals 88 each having associated therewith a corresponding spring contact assembly 90. Towers 46 surround respective HV connector terminals 88. Towers 46 and connector terminals 88 are adapted in size and shape to receive a conventional "boot" portion of ignition cable 20 (not shown).

It is to be understood that the above description is merely exemplary rather than limiting in nature, the invention being limited only by the appended claims. Various modifications and changes may be made thereto by one of ordinary skill in the art, which embodies the principles of the invention and fall within the spirit and scope thereof.

The invention claimed is:

1. An ignition apparatus comprising:

a core formed of magnetically-permeable material extending along a main axis;

a primary winding disposed about the core having a first end configured for connection to a power source and a second end being configured to be selectively coupled to a ground node;

a secondary winding disposed on a secondary winding spool disposed about the core wherein at least one of first and second ends of the secondary winding is electrically connected to a high-voltage connector terminal configured for connection to a spark plug;

a case formed of electrical insulating material; and a magnetically-permeable, electrically-conductive shield disposed inwardly of the case, said shield electrically floating relative to said ground node, wherein said shield is generally cylindrical in shape extending along said main axis, said shield having an opening extending circumferentially and axially relative to said main axis; and wherein said case includes an interior configured to retain a first coil assembly comprising said core, said primary winding, said secondary winding spool, said secondary winding, and said shield, said case further including an exterior surface, said high-voltage connector terminal being substantially surrounded by a tower extending from said exterior surface, said opening of said shield being oriented so as to allow said connection between said secondary winding and said high-voltage connector terminal;

second and third coil assemblies each corresponding in arrangement to said first coil assembly, said case being configured to receive said first, second and third coil assemblies.

2. The apparatus of claim 1 wherein said interior of said case includes a channel configured to receive a first end of said shield, said first end of said shield and said channel arranged for a press-fit coupling therebetween.

3. The apparatus of claim 2 wherein said shield further includes a second end opposite said first end, said apparatus further including an annular shield buffer element configured to engage said second end of said shield.

4. The apparatus of claim 2 wherein said shield further includes a second end opposite said first end that includes a coined edge.

5. The apparatus of claim 2 further including an O-ring seal disposed in said channel, said seal being selected from one of a circular cross-section ring seal and a rectangular cross-section O-ring seal.

6. An ignition apparatus comprising:

a core formed of magnetically-permeable material extending along a main axis;

a primary winding disposed about the core having a first end configured for connection to a power source and a second end being configured to be selectively coupled to a ground node;

a secondary winding disposed on a secondary winding spool disposed about the core wherein at least one of first and second ends of the secondary winding is electrically connected to a high-voltage connector terminal configured for connection to a spark plug;

a case formed of electrical insulating material;

a magnetically-permeable, electrically-conductive shield disposed inwardly of the case;

wherein, said case including an interior configured to retain a first coil assembly comprising said core, said primary winding, said secondary winding spool, said secondary winding, and said shield, said interior of said case includes a channel configured to receive a first end of said shield, said first end of said shield and said channel arranged for a press-fit coupling therebetween, said shield includes a second end opposite said first end, said apparatus including at least one of (i) an annular shield buffer element configured to engage said second end of said shield and (ii) an O-ring seal disposed in said channel.

7. The apparatus of claim 6 wherein said shield is generally cylindrical in shape extending along said main axis, said shield having an opening extending circumferentially and axially relative to said main axis.

8. The apparatus of claim 7 wherein said shield is C-shaped.

9. The apparatus of claim 7 wherein said opening defines a flow path for an encapsulant.

10. The apparatus of claim 7 wherein said case further including an exterior surface, said high-voltage connector terminal being substantially surrounded by a tower extending from said exterior surface, said opening of said shield being oriented so as to allow said connection between said secondary winding and said high-voltage connector terminal.

11. The apparatus of claim 7 wherein said shield further includes a second end opposite said first end that includes a coined edge.

* * * * *